US010849374B2

(12) United States Patent
Clarke

(10) Patent No.: US 10,849,374 B2
(45) Date of Patent: Dec. 1, 2020

(54) GARMENT

(71) Applicant: PUMA SE, Herzogenaurach (DE)

(72) Inventor: Hugh Anthony Clarke, Aurachtal (DE)

(73) Assignee: PUMA SE, Herzogenaurach (DE)

( * ) Notice: Subject to any disclaimer, the term of this patent is extended or adjusted under 35 U.S.C. 154(b) by 0 days.

(21) Appl. No.: 16/620,806

(22) PCT Filed: Jul. 28, 2017

(86) PCT No.: PCT/EP2017/000914
§ 371 (c)(1),
(2) Date: Dec. 9, 2019

(87) PCT Pub. No.: WO2019/020155
PCT Pub. Date: Jan. 31, 2019

(65) Prior Publication Data

US 2020/0196689 A1 Jun. 25, 2020

(51) Int. Cl.
*A41D 13/05* (2006.01)

(52) U.S. Cl.
CPC ..... *A41D 13/05* (2013.01); *A41D 13/0593* (2013.01); *A41D 2500/50* (2013.01)

(58) Field of Classification Search
CPC .... A41D 13/0593; A41D 31/00; A41D 13/05; A41D 13/0151; A41D 13/065; A63B 71/08; A42B 3/125
See application file for complete search history.

(56) References Cited

U.S. PATENT DOCUMENTS 4,905,320 A * 3/1990 Squyers, Jr. ..... A41D 13/015 2/22
5,675,844 A * 10/1997 Guyton ..... A41D 13/015 2/22
5,920,915 A * 7/1999 Bainbridge ..... A41D 7/001 2/456
6,032,300 A * 3/2000 Bainbridge ..... A41D 13/015 2/456

(Continued)

FOREIGN PATENT DOCUMENTS

GB 2148093 A1 5/1985

OTHER PUBLICATIONS

International Search Report of International Application No. PCT/EP2017/000914, dated Mar. 23, 2018, 3 pages.

(Continued)

*Primary Examiner* — Tajash D Patel
(74) *Attorney, Agent, or Firm* — Quarles & Brady LLP

(57) ABSTRACT

The invention relates to a garment (1), especially to a sports garment, comprising a substrate (2) which covers a part of the body of the wearer of the garment (1). To provide a garment of the generic type which has good thermal insulation properties and which is especially suitable for sports the invention proposes that the substrate (2) is at least partially designed as an at least two-layer arrangement, wherein an inner layer (3) is facing the body of the wearer and an outer layer (4) is delimiting the outside of the garment (1), wherein the two layers (3, 4) form a pocket (5) which is filled with a filling material (6) and wherein the filling material (6) are at least partially plastic particles which are arranged loosely in the pocket (5).

19 Claims, 2 Drawing Sheets

(56) References Cited

U.S. PATENT DOCUMENTS

2002/0184690 A1 12/2002 Mitchell

OTHER PUBLICATIONS

Written Opinion of International Application No. PCT/EP2017/000914, dated Mar. 23, 2018, 5 pages.
International Preliminary Report on Patentability (Form IPEA/409) of International Application No. PCT/EP2017/000914, dated Sep. 25, 2019, 21 pages.

* cited by examiner

GARMENT

This application is a U.S. National Stage application, filed pursuant to 35 U.S.C. § 371, of international application no. PCT/EP2017/000914, filed on Jul. 28, 2017, the contents of which is incorporated herein by reference in its entirety.

The invention relates to a garment, especially to a sports garment, comprising a substrate which covers a part of the body of the wearer of the garment, wherein the substrate is at least partially designed as an at least two-layer arrangement, wherein an inner layer is facing the body of the wearer and an outer layer is delimiting the outside of the garment, wherein the two layers form a pocket which is filled with a filling material and wherein the filling material are at least partially plastic particles which are arranged loosely in the pocket.

Such a piece of garment is disclosed in GB 2 148 093 A and in US 2002/184690 A1. One important aspect is a due thermal insulation of the body of the wearer of the garment. Specifically in the case of sports garments the water absorption of the garment is an important aspect. Also, the garment must be designed in such a manner that it is best resistant with regard to odor due to the contact with sweat.

It is an object of the present invention to propose a garment of the kind mentioned above which provides good thermal insulation properties and which is especially suitable for sports. It should be easy to clean the garment by washing and it should be best resistant to odors.

The solution of this object according to the invention is characterized in that the plastic particles consist of expanded (foamed) plastic material of one or more of the group of thermoplastic polyolefin, thermoplastic polyurethane, thermoplastic elastomer and thermoplastic polyamide, wherein the extension of the plastic particles in the three spatial directions is between 1 mm and 5 mm, wherein the shape of the plastic particles is spherical or elliptical and wherein the pocket is filled with plastic particles and a wadding material.

The plastic particles can be shaped as hollow bodies.

The pocket has preferably a lamellar (strip-shaped) design. Thereby, the length of the pocket is preferably between 50 mm and 250 mm. The width of the pocket is preferably between 10 mm and 50 mm. The maximum thickness of the pocket in a direction perpendicular on the outer side of the garment is preferably between 5 mm and 30 mm.

According to a preferred embodiment of the invention a plurality of pockets is arranged parallel to another. The pockets are in this case preferably arranged adjacent to another.

The pockets can be arranged in such a manner at the garment that the longitudinal extension of the pocket extends substantially in a horizontal direction or at an angle below 15° to the horizontal direction when the garment is worn by a wearer who stands upright on the ground.

The substrate is preferably a textile substrate.

Preferably, the outer layer which delimits the pockets is transparent so that the plastic particles are visible.

The pockets can be made by sewing, knitting or weaving of the two layers. Another possibility is that the pockets are made by carrying out a bonding process of the two layers, specifically a heat bonding process, an ultrasonic bonding process or a gluing process.

An embodiment proposes that the wadding material is a non-woven synthetic wadding material.

According to a special embodiment of the invention the garment is a vest and a group of at least 5 adjacent pockets, preferably at least 8 adjacent pockets, is arranged in the stomach (abdomen) and/or chest area of the wearer, when the garment is worn by a wearer, wherein the pockets are arranged one upon the other. In this case it is preferably provided that at least two groups of pockets, preferably four groups of pockets, are arranged which are separated by a vertical line when the garment is worn by a wearer.

Furthermore, the garment can be a vest and two groups of at least three adjacent pockets is arranged in the left upper chest region and in the right upper chest region, wherein the longitudinal extension of the pockets extends at an angle between 15° and 45° to the horizontal direction when the garment is worn by a wearer who stands upright on the ground.

A specific embodiment provides that the garment is a vest and that it has a collar, wherein at least one, preferably two adjacent pockets are arranged which run in circumferential direction around the collar.

Preferably, the garment is a vest and the reverse side of the garment is free from pockets. It is, of course, also possible that pockets are also arranged at the reverse side of the garment. In the case of a vest or the like insulating pockets can for example be arranged in the kidney region of the same.

Also, it should be mentioned that the proposed solution can beneficially be used at different pieces of garment, like garment covering the torso of the wearer (with or without arm sleeves) and pants or trousers.

To summarize some of the core features of the proposed garment as well as some additional features it can said:

The garment is constructed (of partially zoned or fully) of two layers of textile material created into pockets, placed and distributed on said garment. Said pockets are loosely filled with foamed (expanded) plastic particles; the particles are preferably visible.

Preferred materials for the preferably foamed (expanded) plastic particles are mentioned above.

The pockets will be predominantly horizontal (when the garment is worn by a wearer who stands upright on the ground) through to diagonal layout (too much inclination will deposit all the plastic particles in one area).

The plastic particles are loosely arranged in the pockets, i. e. the particles are not attached or glued to each other. Therefore the particles can move freely within the pockets.

Preferably the plastic particles are visible due to a preferred semitransparent nature of the shell material (outer layer) used to create the pockets. Thus, the shell material is preferably semitransparent.

The plastic particles can be arranged in the pockets in different colors including transparent, shades and finishes. The plastic particles can be of different colours and can be pre-mixed before filling into the pockets; also, they can be kept in one solid colour.

The shape of the plastic particles is preferably spherical or ellipsoid; another possible shape is square.

The plastic particles can be mixed with other non-woven synthetic wadding in different percentages for enhanced hand-feel and thermal insulation.

The pockets can be distributed in the garment in order to optimize heat retention and therefore offer thermal benefits to the wearer. The distribution of the pockets is based on the known thermal mapping of a human body and will aid garment design.

As a significant benefit the proposed plastic particles do not absorb (much) water, therefore when washed there are no issues for shape afterwards compared to down.

Also the plastic particles do not absorb smell and therefore are also beneficial for heat insulating garments.

As a further benefit the plastic particles keep their shape after compression unlike down.

Furthermore, the plastic particles do not absorb water or sweat; therefore they are quicker to dry and have a higher degree of sustainability.

Finally, the plastic particles show higher insulation benefits compared to pure down or pure polyester padding in same dimension pockets.

For the filling of the pockets with the plastic particles a semi-automatic down filling machine can be used which can be equipped with an anti-static funnel.

In the drawings an embodiment of the invention is shown.

Figure 1:
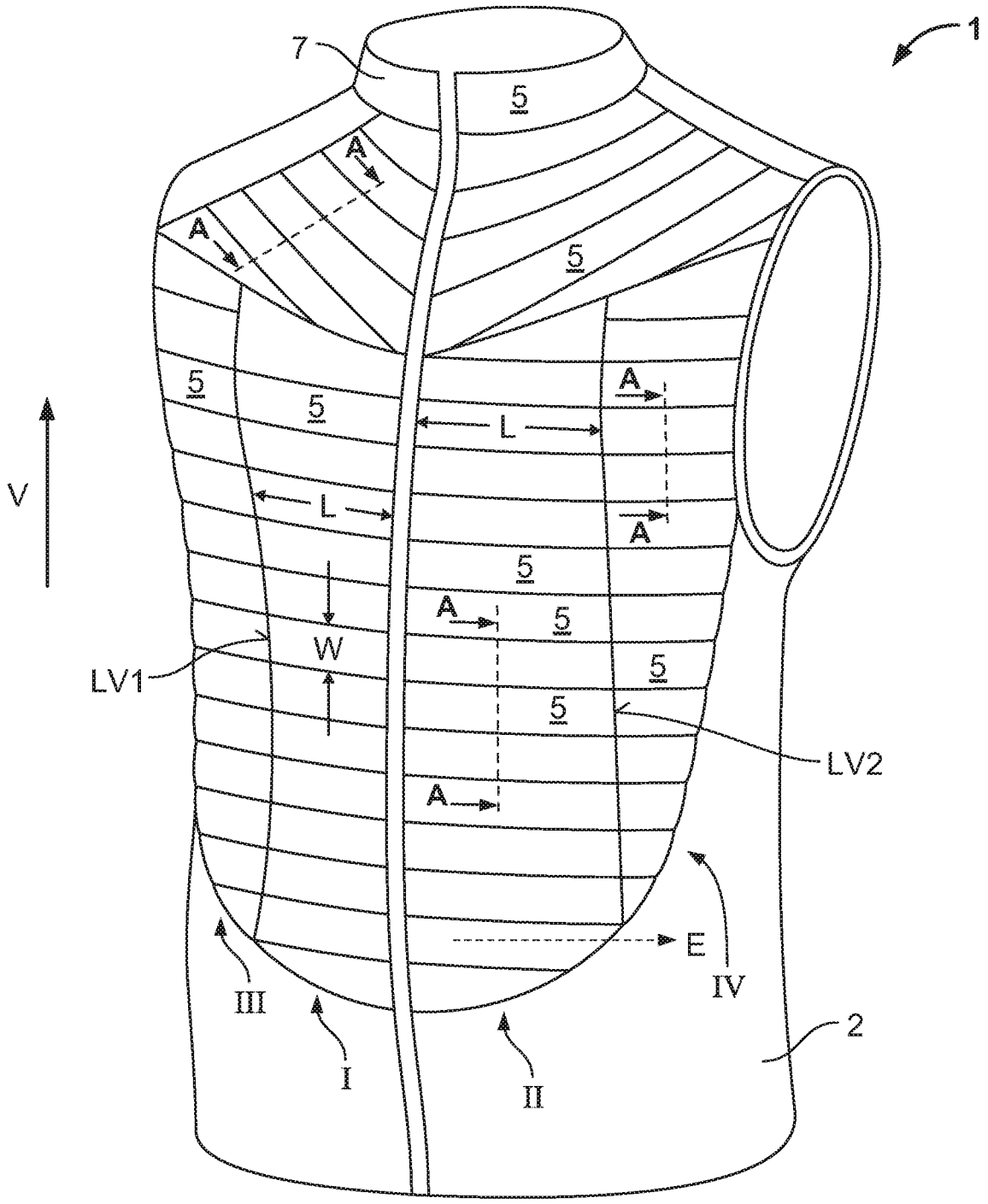
FIG. 1 shows a piece of garment being a vest.

In FIG. 1 a piece of garment 1 is shown which is a vest in the present case. The garment 1 has basically a textile substrate 2 which covers the torso of the body of the wearer. While the rear side (not shown) of the garment 1 consists only of the mentioned substrate 2 a plurality of pockets 5 is arranged on the front side of the garment 1 (as can be seen in FIG. 1) and specifically along the stomach/abdomen area and chest area of the wearer (the location refers to the position when the garment 1 is in intended use).

Figure 2:
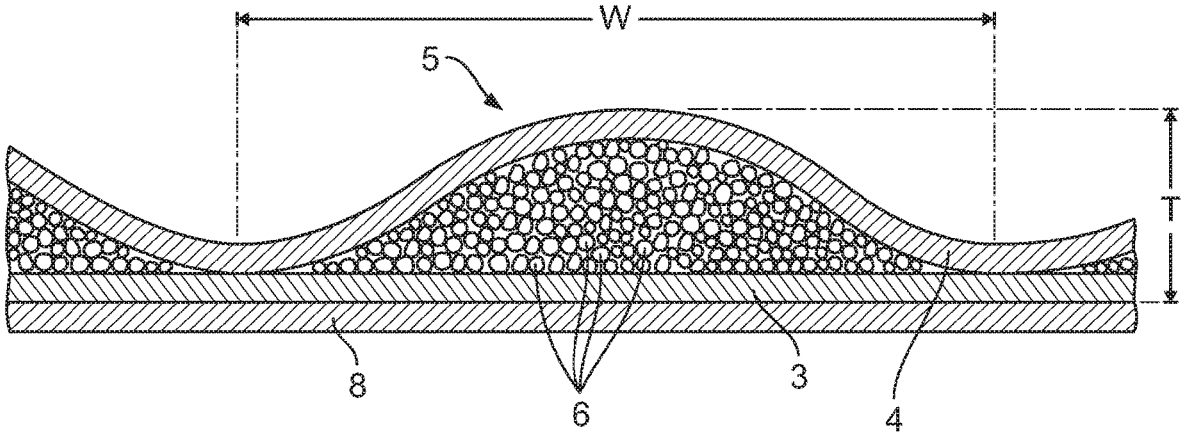
FIG. 2 shows the cross section A-A according to FIG. 1.

The design of the pockets 5 becomes apparent from the cross section according to FIG. 2. Basically, all pockets 5 as arranged on the front side of the garment 1 have the design as shown in FIG. 2.

Accordingly, the garment 1 comprises an inner layer 3 and an outer layer 4 in those regions where pockets 5 are arranged. As an additional feature is can be seen from FIG. 2 that an additional carrier layer 8 can be optionally provided which carries that two layers 3 and 4.

Basically, the two layers 3 and 4 are connected with another at two locations which are defined by the width W of the pocket 5 as can be seen from FIG. 2. The pockets 5 have her substantially lamellar (strip-like) shape as can be seen from FIG. 1. The length of the pockets is denoted with L. Furthermore, from FIG. 2 it can be seen that the pocket 5 has a thickness T. Due to the lamellar shape of the pockets 5 seen in a direction perpendicular to the outer surface of the garment 1 the pockets 5 have a longitudinal extension E as denoted in FIG. 1.

In the present embodiment the pockets 5 are filled with plastic particles which form a filling material 6. An alternative embodiment proposes that the pockets 5 are filled with the plastic particles and a wadding material, especially with a non-woven synthetic wadding material, which both form the filling material 6. The plastic particles are mixed with the non-woven synthetic wadding in different percentages for enhanced hand-feel and thermal insulation.

Preferably, the plastic particles have as spherical or ellipsoid shape and fill the chamber defined by the two layers 3 and 4 as can be seen from FIG. 2.

From FIG. 1 it can be seen, that in the stomach/abdomen and chest area of the wearer, seen during intended use of the garment, four groups of pockets 5 are arranged, namely groups I, II, III and IV.

Each group consists of a plurality of pockets 5 which are arranged one upon the other in vertical direction V (which relates to the direction when the garment is worn by a wearer during intended use and when the wearer is standing upright on the ground).

The single pockets 5 are arranged in such a manner that the longitudinal extension E is substantially directed horizontally.

The group I is divided from group HI by a vertical line LV1 which delimits the single pockets 5. The group II is divided from group IV by a vertical line LV2 which delimits the single pockets 5 as well.

In the upper chest area further groups of pockets 5 are arranged, wherein now the longitudinal extension E of the pockets 5 is arranged under an angle of about 20° to the horizontal direction.

Finally, a collar 7 is arranged at the upper end of the garment 1 which can also be supplied with pockets 5 which run in circumferential direction around the collar 7.

By the proposed design the garment 1 has good insulation properties and is insensitive with respect to odor as the used plastic particles being the filling material of the pockets 5.

REFERENCE NUMERALS

1 Garment (sports garment)
2 Substrate
3 Inner layer
4 Outer layer
5 Pocket
6 Filling material
7 Collar
8 Carrier layer
L Length of the pocket
W Width of the pocket
T Thickness of the pocket
E Longitudinal extension of the pocket
V Vertical direction
LV1 Vertical line
LV2 Vertical line
I Group of pockets
II Group of pockets
III Group of pockets
IV Group of pockets

The invention claimed is:

1. A garment, comprising a substrate which covers a part of a body of a wearer of the garment, wherein the substrate is at least partially designed as an at least two-layer arrangement, wherein an inner layer is facing the body of the wearer and an outer layer is delimiting the outside of the garment, wherein the at least two-layer arrangement forms a pocket which is filled with a filling material, wherein the filling material comprises plastic particles which are arranged loosely in the pocket, wherein the plastic particles consist of an expanded plastic material of one or more of thermoplastic polyolefin, thermoplastic polyurethane, thermoplastic elastomer, and thermoplastic polyamide, wherein an extension of the plastic particles in three spatial directions is between 1 mm and 5 mm, wherein the plastic particles have a spherical or elliptical shape, and wherein the pocket is filled with the plastic particles and a wadding material, the wadding material being mixed with the plastic particles in the pocket.

2. The garment according to claim 1, wherein the plastic particles are shaped as hollow bodies.

3. The garment according to claim 1, wherein the pocket has a lamellar design.

4. The garment according to claim 3, wherein a length of the pocket is between 50 mm and 250 mm.

5. The garment according to claim 3, wherein a width of the pocket is between 10 mm and 50 mm.

6. The garment according to claim 3, wherein a maximum thickness of the pocket in a direction perpendicular to an outer side of the garment is between 5 mm and 30 mm.

7. The garment according to claim 3, wherein a plurality of pockets are arranged parallel to another.

8. The garment according to claim 7, wherein the pockets are arranged adjacent to another.

9. The garment according to claim 3, wherein the pocket is arranged in such a manner in the garment that a longitudinal extension of the pocket extends substantially in a horizontal direction or at an angle below 15° to the horizontal direction when the garment is worn by the wearer who stands upright on a ground.

10. The garment according to claim 1, wherein the substrate is a textile substrate.

11. The garment according to claim 1, wherein the outer layer is made from a transparent material.

12. The garment according to claim 1, wherein a plurality of pockets are made by sewing, knitting or weaving of the two layers.

13. The garment according to claim 1, wherein a plurality of pockets are made by carrying out a heat bonding process, an ultrasonic bonding process, or a gluing process of the two layers.

14. The garment according to claim 1, wherein the wadding material is a non-woven synthetic wadding material.

15. The garment according to claim 3, wherein the garment is a vest and the garment comprises a group of at least 5 adjacent pockets arranged in a stomach or a chest area of the wearer, when the garment is worn by the wearer, wherein the pockets are arranged one upon the other.

16. The garment according to claim 15, wherein at least two groups of pockets are separated by a vertical line when the garment is worn by the wearer.

17. The garment according to claim 3, wherein the garment is a vest and the garment comprises two groups of at least three adjacent pockets that are arranged in a left upper chest region and in a right upper chest region, wherein a longitudinal extension of the pockets extends at an angle between 15° and 45° to a horizontal direction when the garment is worn by the wearer who stands upright on the ground.

18. The garment according to claim 3, wherein the garment is a vest and the garment comprises a collar, wherein at least one pocket is arranged to run in a circumferential direction around the collar.

19. The garment according to claim 1, wherein the garment is a vest and a reverse side of the garment is free from pockets.

* * * * *